United States Patent [19]

Egami et al.

[11] Patent Number: 4,660,958

[45] Date of Patent: Apr. 28, 1987

[54] DEVELOPING APPARATUS

[75] Inventors: Hidemi Egami, Zama; Fumitaka Kan, Yokohama; Atsushi Hosoi, Tokyo; Hatsuo Tajima, Matsudo; Shunji Nakamura; Kimio Nakahata, both of Kawasaki, all of Japan

[73] Assignee: Canon Kabushiki Kaisha, Tokyo, Japan

[21] Appl. No.: 607,659

[22] Filed: May 7, 1984

[30] Foreign Application Priority Data

| | | | |
|---|---|---|---|
| Sep. 16, 1983 | [JP] | 09161983 | 58-169300 |
| May 10, 1983 | [JP] | Japan | 58-80101 |
| May 10, 1983 | [JP] | Japan | 58-80103 |
| Jun. 14, 1983 | [JP] | Japan | 58-104984 |
| Jun. 14, 1983 | [JP] | Japan | 58-104988 |
| Jun. 14, 1983 | [JP] | Japan | 58-104989 |
| Jun. 14, 1983 | [JP] | Japan | 58-104990 |
| Aug. 18, 1983 | [JP] | Japan | 58-149667 |

[51] Int. Cl.[4] ..... G03G 15/08

[52] U.S. Cl. ..... 355/3 DD; 355/3 R; 355/14 D; 118/658; 430/122

[58] Field of Search ..... 355/3 DD, 14 D, 3 R; 118/658; 430/122

[56] References Cited

U.S. PATENT DOCUMENTS

| | | | |
|---|---|---|---|
| 4,226,525 | 10/1980 | Sakamoto et al. | 355/3 DD X |
| 4,244,322 | 1/1981 | Nomura et al. | 118/658 |
| 4,373,798 | 2/1983 | Tsukada et al. | 355/3 DD |
| 4,406,535 | 9/1983 | Sakamoto et al. | 355/3 |
| 4,435,065 | 3/1984 | Wada | 355/3 DD |
| 4,466,728 | 8/1984 | Schlageter et al. | 355/3 DD |
| 4,478,505 | 10/1984 | Tashiro | 355/3 DD |
| 4,491,161 | 1/1985 | Tamura et al. | 355/3 DD X |
| 4,511,239 | 4/1985 | Kanbe et al. | 355/3 DD |

*Primary Examiner*—A. C. Prescott

*Attorney, Agent, or Firm*—Fitzpatrick, Cella, Harper & Scinto

[57] ABSTRACT

A developing apparatus includes a developer supply container, having an opening, for containing a non-magnetic developer and magnetic particles, an endlessly movable developer carrying member of a non-magnetic material for carrying a developer, which is movable between an inside of the developer supply container and an outside of the developer supply container through the opening, a magnetic particle confining member, provided to an outer surface of the developer carrying member with a gap, a magnet for generating a fixed magnetic field, having a magnetic pole disposed inside of the carrying member and upstream of the confining member with respect to movement of the carrying member, and a magnet, disposed outside of the carrying member and downstream of the confining member with respect to movement of the carrying member, for forming a line of magnetic force extending therefrom to the confining member.

18 Claims, 28 Drawing Figures

DEVELOPING APPARATUS

BACKGROUND OF THE INVENTION

1. Field of the Invention

The present invention relates to a device for forming a thin layer of dry developer particles on a developer carrying member, and to a developing apparatus for performing the developing function with the thus formed thin layer, more particularly, to the thin layer forming device for forming a thin layer of non-magnetic developer particles, and to the developing apparatus for performing the developing function with the thus formed thin layer of non-magnetic developer particles.

2. Description of the Prior Art

Conventionally, various types of apparatus have been proposed and put into practice as to a dry type one-component developer apparatus. However, in any of those types, it has been very difficult to form a thin layer of one-component dry developer, so that a relatively thick layer of the developer is used. On the other hand, the recent device for improved sharpness, resolution or other qualities has necessiated the achievement of a system for forming a thin layer of one-component dry developer.

A method of forming a thin layer of one-component dry developer has been proposed in U.S. Pat. Nos. 4,386,577 and 4,387,664 and this has been put into practice. However, they describe the formation of a thin layer of a magnetic developer, not of a non-magnetic developer. The particles of a magnetic developer must each contain a magnetic material to gain a magnetic nature. This is disadvantageous since it results in poor image fixing when the developed image is fixed on a transfer material, also in poor reproducibility of color (because of the magnetic material, which is usually black, contained in the developer particle).

Therefore, there has been proposed a method wherein the developer is applied by means of a cylindrical soft brush made of, for example, beaver fur, or a method wherein the developer is applied by a doctor blade to a developer roller having a textile surface, such as velvet, for formation of non-magnetic developer thin layer. In the case where the textile brush is used with a resilient material blade, it would be possible to regulate the amount of the developer applied, but the applied toner layer is not uniform in thickness. Moreover, the blade only rubs the brush so that the developer particles are not charged, resulting in foggy images.

A method and a device wherein a thin layer of non-magnetic developer is formed with the use of magnetic particles confined by a magnetic field, are proposed in U.S. Ser. Nos. 466,574 and 527,397, both of which have been assigned to the assignee of the subject application.

It is practically desirable in using such a device that the developer does not fall and/or scatter when the developing device is handled or carried. Additionally, if the magnetic particles are not present at a proper region, the non-magnetic developer particles which have not been transferred to a latent image bearing member at a developing station may scatter from a developer supply container at an opening of the container to which the developer returns. Further, the magnetic particles can leak through the opening. It is, therefore, desirable that the magnetic particles are confined within the container at the proper region. It has further been found that, if the circulation of the magnetic particles within the container is not sufficient, the triboelectric charging to the developer is so weak so that the non-magnetic developer particles are deposited with such a small force that the resultant developed image has a foggy background.

In this type of thin layer forming device, it is required that the magnetic particles are confined surely within the container by a magnetic particle confining member. However, in the case where the distribution of the magnetic particle diameters is so broad that there are magnetic particles having a diameter smaller than that of the non-magnetic developer particles, it is possible that those small diameter magnetic particles are undesirably contained in the formed thin layer. Also, if the flowability of the developer is increased in order to extends the life of the developer, the magnetic particles are possibly not sufficiently confined and tend to leak out. If the magnetic particles are contained in the thin layer coating, they can transfer to the latent image bearing member to deteriorate the quality of the developed image, or they can damage the latent image bearing member.

SUMMARY OF THE INVENTION

Accordingly, a principal object of the present invention is to provide a developing apparatus which is substantially free from the falling or scattering of the developer particles when the developing apparatus is handled or carried.

Another object of the present invention is to provide a developer thin layer forming device and a developing apparatus which is substantially free from the falling or scattering of the non-magnetic developer particles.

A further object of the present inventin is to provide a developer thin layer forming device and a developing apparatus wherein there is provided means for assuring that the magnetic particles are collected and confined at the portion where the magnetic particles return into the container.

A further object of the present invention is to provide a developer thin layer forming device and a developing apparatus wherein the magnetic particles are sufficiently circulated within the container.

A further object of the present invention is to provide a developer thin layer forming device and a developing apparatus wherein possible adverse affects by the magnetic particles contained in the thin layer are avoided.

According to the embodiments of the present invention, which will be described in detail hereinafter, a thin layer of the developer is triboelectrically charged to a satisfactory extent so that a uniform development is effected; the fixing of the developed images is better; and/or a non-magnetic developer which is of better color reproducibility can be used.

These and other objects, features and advantages of the present invention will become more apparent upon a consideration of the following description of the preferred embodiment of the present invention taken in conjunction with the accompanying drawings.

DETAILED DESCRIPTION OF THE PREFERRED EMBODIMENTS

The preferred embodiment of the present invention will be described in detail in conjunction with the accompanying drawings.

Figure 1:
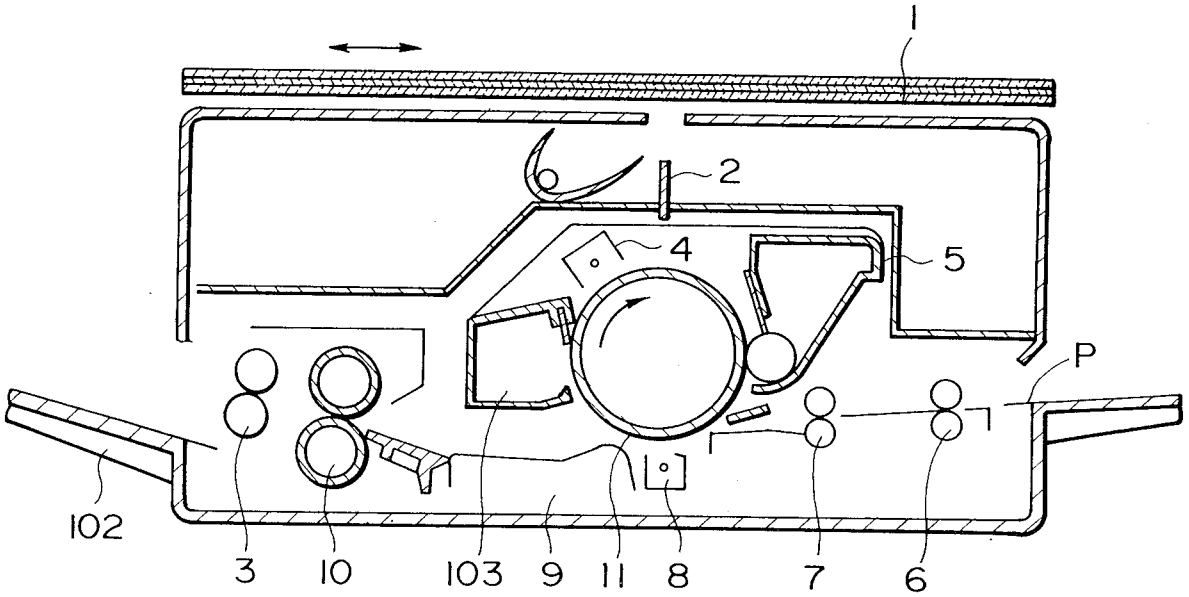
FIG. 1 is a cross-sectional view of an example of electrophotographic copying apparatus to which the present invention is applicable.

FIG. 1 is a cross-sectional view of an electrophotographic copying apparatus incorporating the thin layer forming device and the developing apparatus according to an embodiment of the present invention. The copying apparatus is shown as a personal type copying machine which comprises a horizontally reciprocable original carriage having a transparent member, an array 2 of short focus lenses having a small diameter, and a photosensitive member 11 on which an image of the original placed on the original carriage 1 is projected through a slit by the lens array 2. The photosensitive member 11 is shown as a drum, but it may be an endlessly movable web. The photosensitive member 11 is uniformly charged by a charger 4, and then exposed to the image light through the lens array 2 so that an electrostatic latent image is formed thereon. The thus formed electrostatic latent image is visualized by the developing apparatus 5 according to the prsent invention. On the other hand, a transfer material P is fed by a feed roller 6 and a registration roller7 which feeds the transfer material P in timed relation with the image formed on the photosensitive member 11. The visualized image (toner image) on the photosensitive member 11 is then transferred onto the transfer material P by a transfer discharger 8. The transfer material P is separated from the photosensitive member 11, and then conveyed along a guide 9 to an image fixing device 10, whereat the toner image is fixed on the transfer material P. Finally, the transfer material is discharged to a tray 102 by discharging rollers 3. The photosensitive member 11, the charger 4, the developing apparatus 5 and a cleaning device 103 for removing residual developer from the photosensitive member 11 after image transfer, may be constructed as a unit which is mountable into or demountable from the main assembly of the copying apparatus, thus simplifying the maintenance operation.

Figure 2:
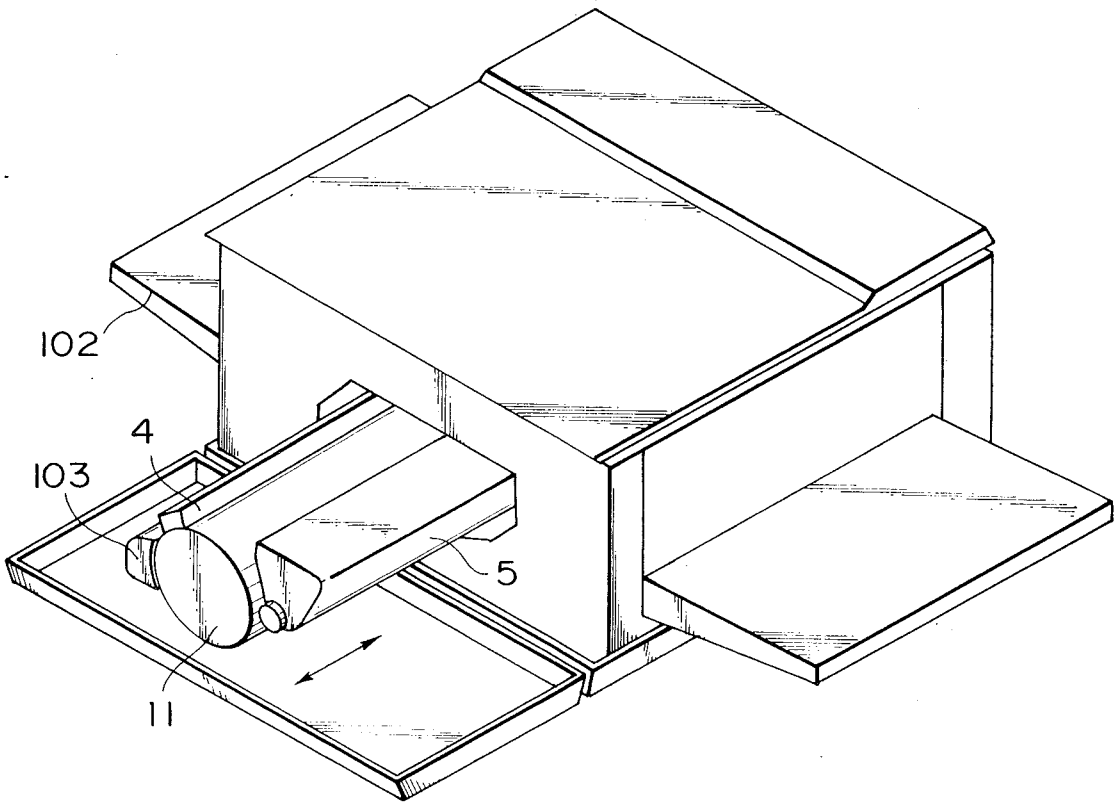
FIG. 2 is a perspective view of a electrophotographic process unit containing a photosensitive member, a discharger, a developing device and others, when the unit is being removed or attached.

FIG. 2 shows a perspective view of a process unit for a copying apparatus, wherein the process unit is, for example, being removed from the apparatus after a front door is opened. The process unit is moved in the direction shown by the arrow upon mounting and demounting. The present invention is particularly advantageous, when used with such types of copying apparatus.

Figure 3:
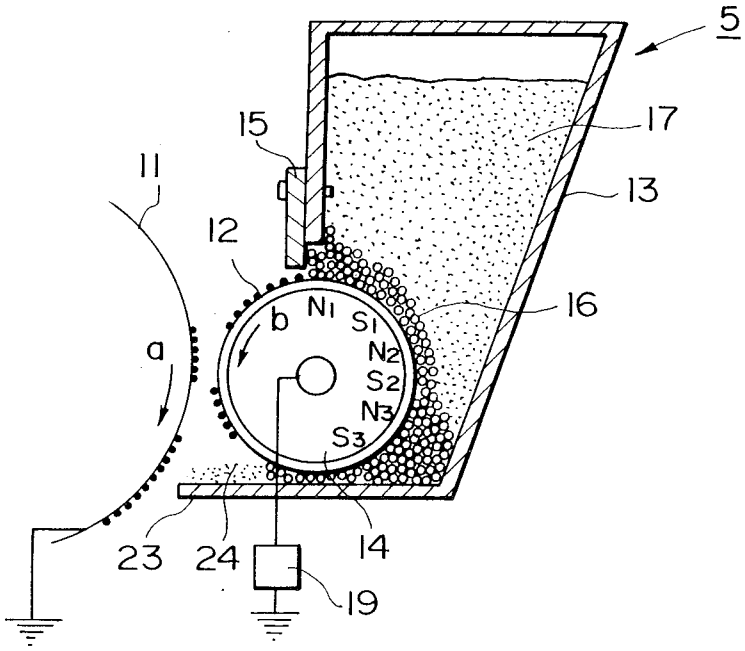
FIG. 3 is a cross-sectional view of a developing apparatus usable with the copying apparatus shown in FIG. 1.
Figure 6:
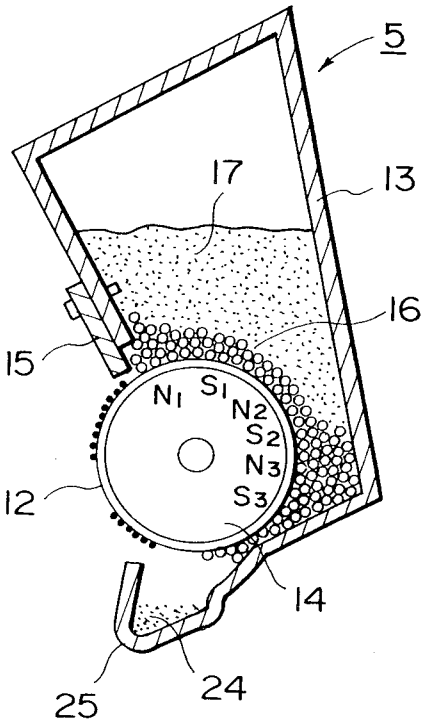
FIG. 6 is a cross-sectional view of the developing apparatus of FIG. 5 when the apparatus is inclined.

FIG. 3 illustrates a developer thin layer forming device or a developing apparatus usable with the above-described copying apparatus, wherein the photosensitive member 11 rotates in the direction of arrow a. Opposed to the surface of the photosensitive member 11 with a gap, a non-magnetic member 12 for carrying a developer is provided. In this embodiment, the developer carrying member 12 is in the form of a cylinder, or more particularly, a sleeve, but it may be an endlessly movable web, as with photosensitive member 11. With the rotation of the photosensitive member 11, the carrying member 12 is rotated in the direction of arrow b. A developer supply container 13 is provided to supply the developer to the carrying member 12. The container 13 is provided with an opening adjacent its lower part. The carrying member 12 is provided in the opening. Since the carrying member 12 is partly exposed outside, the surface thereof moves from the inside of the container 13 to the outside thereof and then back into the container 13. Inside the carrying member 12, magnetic field generating means, i.e., a magnet 14 in this embodiment, is fixedly supported so that the carrying member 12 only rotates. The magnet 14 has magnetic poles N1, S1, N2, S2, N3 and S3.

In the neighborhood of the upper part of the container 13 opening, a confining member 15, as magnetic particle confining means, is provided to confine within the container 13 magnetic particles which will be described hereinafter. The confining member 15 is of a magnetic material, i.e., a magnetic blade in this embodiment. Across the carrying member 12 from the confing member 15, there is a magnetic pole N1 of the magnet 14. However, the magnetic pole N1 is not right across, and displaced by a predetermined angle $\theta$ (5–50 degrees) toward upstream with respect to the direction of the movement of the carrying member 12.

Into the container 13 of the above-described structure, magnetic particles or a mixture of magnetic particles and non-magnetic developer particles are supplied so that a base layers 16 is formed. The mixture constituting the base layer 16 preferably contains 5–70 wt.% of non-magnetic developer, but may only have magnetic particles. The particles diameter of the magnetic particle is 30–200, preferably 70–150 microns. Each of the magnetic particles may consist of a magnetic material or may consist of a magnetic material and non-magnetic material. The magnetic particles in the base layer 16 are formed into a magnetic brush by the magnetic field provided by the magnet 14, which brush is effective to perform a circulation which will be described in detail hereinafter. A magnetic brush is also formed between the magnetic pole N1 and the magnetic particle confining member 15, which is effective to constrain the magnetic particles of the base layer 16 within the container 13.

Above the base layer 16, non-magnetic developer particles are supplied to form a developer layer 17, so that two layers are formed generally horizontally in the container 13, that is, the base layer 16 on the outside of the carrying member 12 and the developer layer 17 further outside thereof. The non-magnetic developer supplied may contain a small amount of magnetic particles, but even in that case, the magnetic particle content of the developer layer 17 is smaller than that of the base layer 16. To the non-magnetic developer particles, silica particles for enhancing the flowability and/or abrasive particles for effectively abrading the surface of the photosensitive member 11 may be added.

The formation of the two layers is not limited to this manner, i.e., two materials are supplied separately, but may be made, for example, by supplying a uniform mixture of the magnetic particles and non-magnetic developer containing the sufficient amount of respective materials for the entire base layer 16 and developer layer 17, and then vibrating the container 13 to form the two layers, using the magnetic field of the magnet 14 and the difference in the specific gravity between the two materials.

Figure 4:
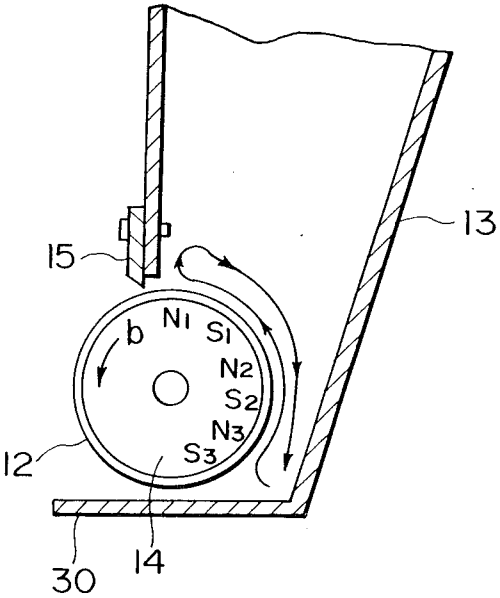
FIG. 4 is a cross-sectional view of a developing apparatus of FIG. 3, showing a circulation of the magnetic particles.

After the two layers are formed as described above, carrying member 12 is rotated. The magnetic particles are circulated by the magnetic field provided by the magnetic poles and the gravity, as shown in FIG. 4. More particularly, in the neighbourhood of the surface of the non-magnetic developer carrying member 12 near the bottom of the container 13, the magnetic particles move upwardly along the surface of the carrying member 12 by the cooperation of the magnetic field of the magnet 14 and the rotation of the carrying member 12. During this movement, the non-magnetic developer particles contact the carrying member 12 surface so that the non-magnetic developer contained in the base layer 16 is coated on the carrying member 12 surface electrostatically.

In this embodiment of the present invention, the non-magnetic developer is triboelectrically charged by the contact with the magnetic particles and with the carrying meember 12. Preferably, however, the triboelectric charge with the magnetic particles is reduced by treating the surface of the magnetic particles with an insulating material, such as oxide coating and a resin having the same electrostatic level as the non-magnetic developer, so that the necessary charging is effected by the contact with the carrying member 12 surface. Then, the deterioration of the magnetic particles is prevented, and simultaneously, the non-magnetic develope is stably coated on the carrying member 12.

The magnetic particles are moved upwardly too by the rotation of the carrying member 12, but prevented from passing through the clearance between the tip of the magnetic particle confining member 15 and the carrying member 12 by the magnetic field formed between the confining member 15 and magnetic pole N1. The magnetic particles behind the confining member 15 within the container 13 are urged by the magnetic particles fed continuously from the bottom of the container 13, and turn, as shown in FIG. 4, whereafter they slowly move down under the gravity. During this downward movement, the magnetic particles take the non-magnetic developer particles among themselves from the lower part of the developer layer 17. Then, the magnetic particles return to the bottom part of the container 13, and those actions are repeated.

On the other hand, the triboelectrically charged non-magnetic developer particles, which are non-magnetic, are not limited by magnetic field existing in the clearance between the tip of the confining member 15 and the surface of the carrying member 12, so that they are allowed to pass there, and they are coated as a thin layer of uniform thickness on the carrying member 12 by the magnetic brush formed at the confining member 15 and by the image force. The thin layer of the non-magnetic developer is thus conveyed out of the container 13, and moved to the developing station, where the thin layer is opposed to the photosensitive member 11 to develop a latent image thereon.

Supplying a substantially uniform mixture of the magnetic particles and non-magnetic developer particles instead of formation of the two layers, is practicable if the mixture contains an amount of magnetic particles to form the sufficient magnetic brush. For the purpose of the long term stability of the magnetic brush, the formation of two layer is preferable.

The developing system to be used here is preferably the non-contact type development disclosed in U.S. Pat. No. 4,395,476, although conventional contact type development is usable. Between the photosensitive member 11 and the carrying member 12, a voltage is applied by a bias voltage source 19 which is of AC, DC or preferably an AC superposed with a DC. The use of the developing bias is preferable in all of the embodiments which will be described hereinafter.

The developer to be consumed for the development is supplied from the base layer 16, and the consumption of the developer in the base layer 16 is compensated from the developer layer 17 during the above-described circulation.

Since the base layer 16 is formed around the carrying member 12 from the beginning, and since the developer layer 17 does not contain the magnetic particles, or if any, it contains only a small amount to compensate the unavoidably lost magnetic particles, the state of the magnetic brush formed in the base layer 16 is maintained constant over a long run of the device. In this sense, the magnetic particles within the base layer 16 is a part of the developing or thin layer forming apparatus, rather than a developer or a part of a developer.

It is preferable that the surface of the carrying member 12 contacts only the base layer 16 and does not directly contact the developer layer 17 so that the conveying force of the carrying member 12 is not transmitted to the developer to maintain constant the developer content of the base layer 16, irrespective of the amount of the non-magnetic developer in the developer layer 17.

In the developing station shown in FIG. 3, the non-magnetic developer transfers to the photosensitive member 11, wherein the developer particles become like a cloud due to a flow of air caused by the rotation of the photosensitive member 11 and the carrying member 12, due to the weight of the developer particles themselves and due to the centrifugal force by the rotation of the carrying member 12, so that the developer particles not having been deposited on the photosensitive member 11 scatter and finally accumulate at the bottom portion 23 of the container 13. If the process unit including the developing means, the thin layer forming means, the photosensitive member 11 and/or discharging means, is taken out of the copying apparatus, the developing means is possibly inclined intentionally or unintentionally, with the result that the accumulated particles at bottom portion 23 ot the container 13 are scattered. If the developer were magnetic, a magnet might be provided within the carrying member 12 to prevent the scattering by a magnetic force, or attract the scattered developer particles by the magnet force. However, in the present case where the developer is non-magnetic, such does not work.

Figure 5:
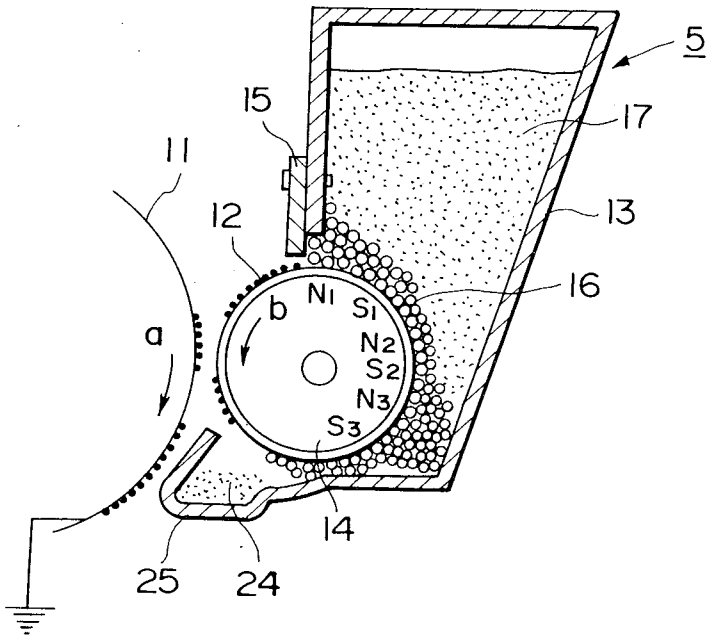
FIG. 5 is a cross-sectional view of a developing apparatus according to an embodiment of the present invention.

FIG. 5 shows an embodiment of the present invention which obviates the problem. In this embodiment, developer collecting means 25 is provided at the bottom of the container 13, which is, in this embodiment, a bent portion of the bottom part of the container 13, but which may be formed by a separate member. The angle of bending is preferably more than 90 degrees, since then it can prevent not only the possible scattering in the copying apparatus during operation of the copying apparatus, but also the scattering and falling of the developer 31 in the developer collecting means 25 is prevented when the developing device is inclined. During the operation of the copying apparatus, the top surface of the non-magnetic developer 31 usually becomes substantially horizontal because of unavoidable vibration. It may be possible in some unusual states that the developer 31 is irregularly accumulated. Even on that occasion, however, the developer 31 is properly confined so as not to scatter out.

As explained above, according to this embodiment of the present invention, the developer not having been transferred to the photosensitive member 11 is effectively prevented by a simple structure from scattering around inside or outside of the copying apparatus, during the copying operation, maintenance operation and the exchange of the unit.

Figure 7:
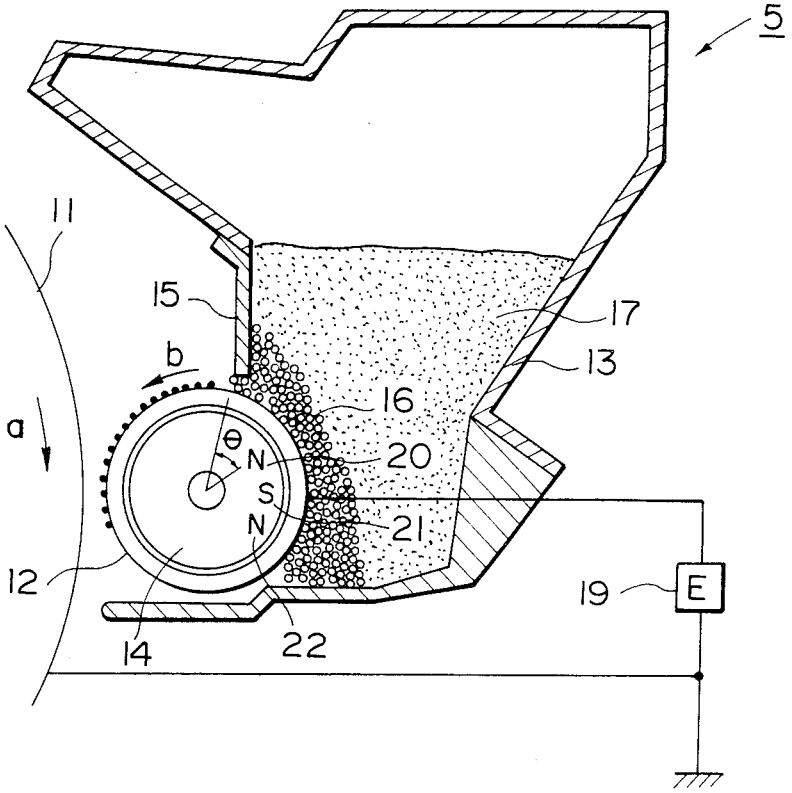
FIG. 7 is a cross-sectional view of a developing apparatus according to another embodiment of the present invention.

FIG. 7 shows another embodiment of the present invention. Since this embodiment is similar to the embodiment described with FIG. 5, except for the portions which will be described, the detailed description of the similar parts is omitted for the sake of simplicity by assigning the same reference numerals to the elements having corresponding functions. The magnet 14 includes as confining magnetic pole 20, the conveying magnetic pole 21 and ladling magnetic pole 22 which will be described in detail hereinafter. The ladling pole 22 is effective to catch the magnetic particles existing at the lower portion of the container 13 and feed them to the conveying pole 21 on the surface of the carrying member 12 and also effective to prevent the developer from leaking out of the bottom of the container 13.

Figure 8:
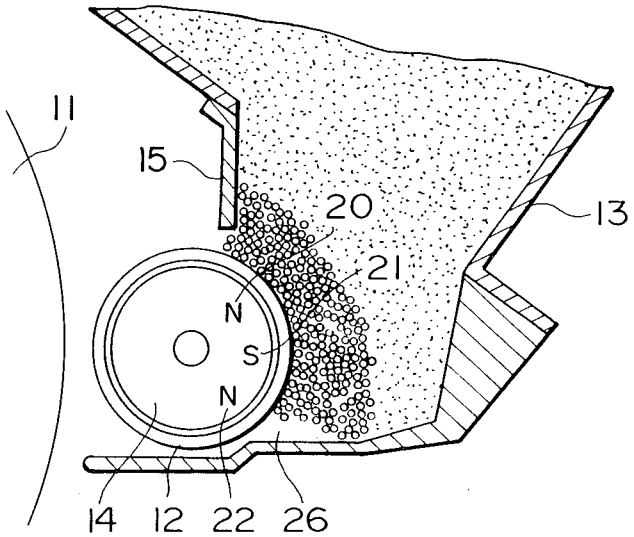
FIG. 8 is a cross-sectional view of the developing apparatus of FIG. 7, showing the state after operated for a long period of time.

By this structure, a substantially satisfactory device for forming a thin layer of developer is provided, but, with the long term and repeated operation, the region in which the magnetic particles are present tends to change to the state shown in FIG. 8, that is, the magnetic particle are separated from the bottom of the container 13 opening as shown in FIG. 8 by reference numeral 26. The separation region 26 becomes larger with the increase of the number of copies made, even to such an extent that the non-magnetic developer particles leak out of the container 13 through the separated region 26 and scatter around to stain the inside copying apparatus. Additionally, since the developer particles are not magnetic so that they are insensitive to magnetic force, they fall from the opening of the container 13 when the developing device is taken out of the copying apparatus and inclined. Therefore, there may still be a difficulty in the maintenance operations.

The magnetic particles as a whole in the container 13 are subjected to the conveying force in a counterclockwise direction about the center of the carrying member 12 by the rotation of the carrying member 12 and the magnetic field of the magnet 14, so that there is a tendency of producing a relatively large cavity below the carrying member 12. More particularly, with the increase of the total number of revolutions, the magnetic particles as a whole are urged toward the confining pole 20, and the urged state is maintained, with the result of the decrease of the magnetic particles at the bottom of the container 13, thus creating a region which is short of the magnetic particles. If this occurs, the sealing effect for the magnetic particles is reduced.

Figure 9:
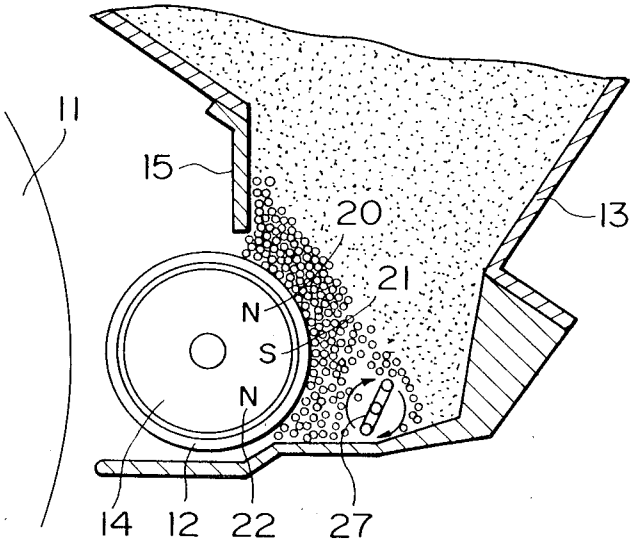
FIG. 9 is a cross-sectional view of a developing apparatus according to a further embodiment of the present invention.

FIG. 9 shows a further embodiment of the present invention, which eliminates these problems, wherein a stirring member 27 is provided adjacent the bottom of the container 13, which rotates in the direction shown by the arrow (the direction toward the carrying member 12 at the lower portion) to positively move the magnetic particles at the bottom of the container 13 toward the bottom of the opening. By doing so, the region full of the non-magnetic developer is prevented from taking place adjacent to the bottom of the container 13 and adjacent the surface of the the carrying member 12, so that the possible scattering and leakage there are avoided. The configuration of the magnetic particle region as a whole is such that it is larger toward the bottom of the container 13, thus enhancing the sealing effect. In addition, the distance through which the magnetic particles and the non-magnetic developer particles are conveyed on the surface of the carrying member 12, is increased with the result that the triboelectric charge to the non-magnetic developer particles is amplified and stabilized, which is ultimately effective to provide non-foggy developed images.

Therefore, the stirring member 27 prevents the leakage and scattering at the bottom of the container 13 even after the copying apparatus is operated for a long period of time. Also, the leakage and scattering are avoided when the developing device is mounted into or demounted from the apparatus. The proper rotational speed of the stirring member 27 is dependent on various factors, such as saturated magnetization and particle size distribution of the magnetic particles, particle size and triboelectric charge of the non-magnetic developer, but generally, 8–60 r.p.m. is proper.

When the device according to the foregoing embodiment was actually operated, good images with constant density were provided irrespective of the ratio of the non-magnetic developer to the magnetic particles. And, it has been confirmed that the device is relatively insensitive to the change of ambient conditions.

According to this embodiment of the present invention, the presence of the magnetic particles adjacent to the bottom of the container 13 where the developer which has not been transferred to the photosensitive member 11 returns, is assured, so that the possibility of leakage and scattering is effectively prevented, and that the triboelectric charge to the developer is made sure, thus preventing occurrence of background fog of developed images.

Figure 10:
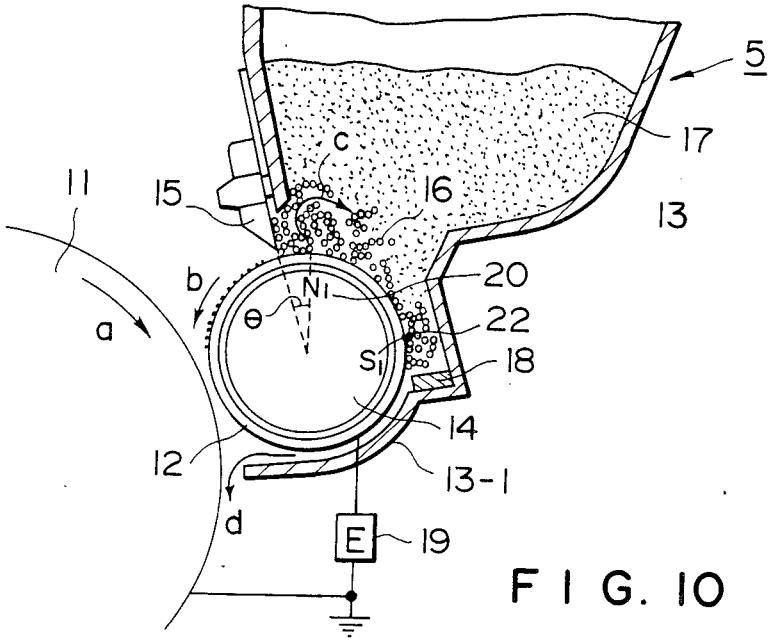
FIG. 10 is a cross-sectional view of a developing apparatus.
Figure 12:
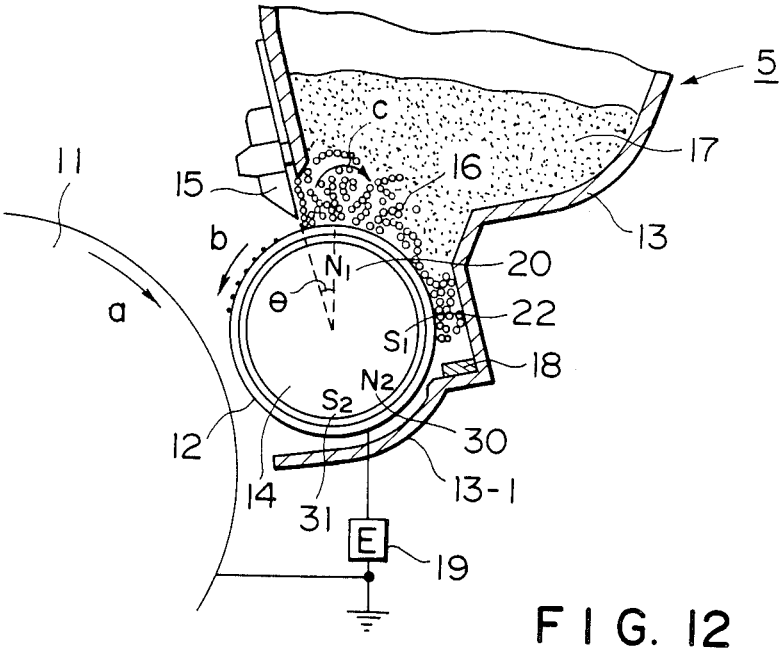
FIG. 12 is a cross-sectional view of a developing apparatus according to a further embodiment of the present invention.
Figure 11:
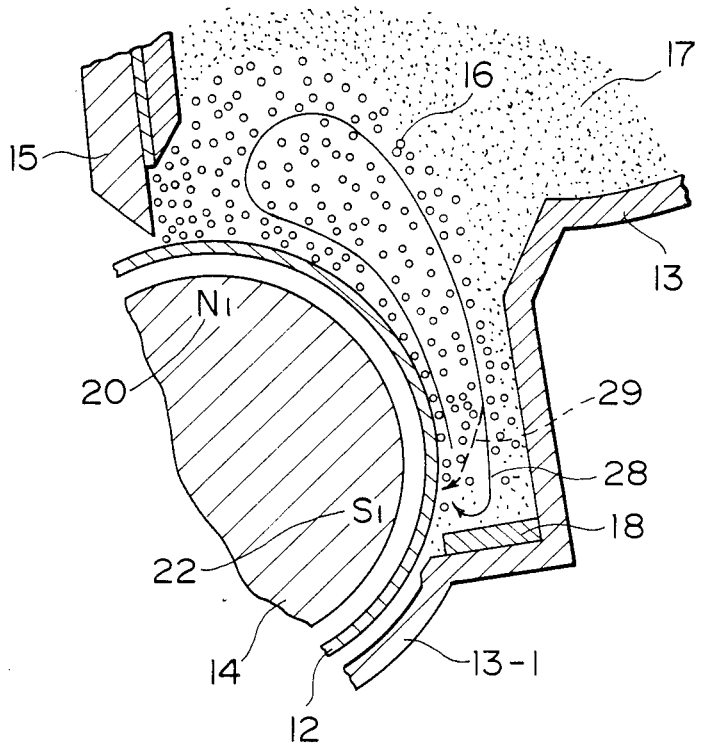
FIG. 11 is a cross-sectional view of a developing apparatus of FIG. 10, showing the circulation of magnetic particles.

FIGS. 10–12 show a further embodiment of the present invention. Since this embodiment is similar to the embodiment described with FIGS. 5 and 7, except for the portions which will be described, the detailed description of the similar parts is omitted for the sake of simplicity by assigning the same reference numerals to the elements having corresponding functions.

As shown in FIG. 10, the magnet 14 includes a confining pole 20 and a sealing pole 22.

On a part of the inside of the container 13 wall, which is opposed to a sealing pole 22 an iron piece 18 is secured, which may be another metal or a magnet having the magnetic pole of the polarity opposite to that of the sealing pole 22. A magnetic brush is formed therebetween to seal the bottom of the container 13 and also to improve the circulation of the magnetic particles. Instead of using a separate member attached to the wall of the container 13 as the above piece, the same effect may be provided by simply approaching the part of the container 13 wall toward the carrying member 12 at the portion opposed to the sealing pole 22, when the container 13 wall is made of a magnetic material such as steel.

FIG. 12 illustrates the function of the sealing pole 22. A magnetic brush is formed between the sealing pole 22 and the magnetic member 18 provided opposed to the sealing pole 22 and adjacent to the bottom of the opening of the container 13. To understand the function of the magnetic brush, the situation without the magnetic member 18 will first be considered. The magnetic particles circulate at the initial stage, as shown in FIG. 11 by reference numeral 28. Therefore, the magnetic particles are sufficiently supplied to the sealing pole 22 to form a satisfactory magnetic brush, thus the bottom of the container 13 is completely sealed by the magnetic brush preventing leakage and scattering of the non-magnetic developer particles. With the increase of the total number of the carrying member 12 revolutions, most of the magnetic particles are urged toward the neighborhood of the confining pole 20 and stagnate there. Correspondingly, the amount of the magnetic particles existing near the sealing pole 22 decreases. Finally, the circulation of the magnetic particles becomes as shown in FIG. 11 by reference numeral 29. As a result, non-magnetic developer particles stagnate or accumulate at the bottom of the container 13 and leak out and/or scatter upon vibration of the machine or the developing device, since there is no magnetic brush. It is, therefore, desired to prevent the reduction of the magnetic particle at the bottom of the container 13, and make it possible to seal it at all times.

This is done by the the magnetic member 18. Due to the provision theof, the non-magnetic developer does not leak or scatter even after the long term operation. Additionally, it does not leak or scatter when the developing device is mounted into or demounted from the copying apparatus. The proper magnetic flux density of the sealing pole 22 is dependent on various factors, such as saturated magnetization and particle size distribution of the magnetic particles, particle size and triboelectric charge of the non-magnetic developer, and also, the configuration of the magnetic member 18 and the distance between the magnetic member 18 and the sealing pole 22, but it is 200–600 G when a plate-like magnetic member 18 is used and spaced apart from the surface of the carrying member 12 by 0.5–1 micron, and the saturated magnitization is approx. 100 emu/g.

As described above, the combination of the magnetic member 18 and the sealing pole 22 is effective to prevent leakage and scattering of non-magnetic developer. However, it has been found that a part of the magnetic brush, particularly, the part at the upstream side thereof with respect to the rotational direction of the carrying member 12, can be released from the magnetic binding force, and it is torn. If this occurs, the developer particles and/or the magnetic particles accumulate in a lower enclosure 13-1. This tends to take place, when a relatively strong vibration is imparted to the developing device. Further, when the magnetic particles, non-magnetic developer particles or the mixture thereof is supplied into the container 13, the magnetic particles can go to the lower enclosure 13-1 before a sufficient magnetic brush is established between the sealing pole 22 and the magnetic member 18. This is particularly remarkable when the flowability of the developer is high. The acccumulated developer can leak and scatter as shown in FIG. 10 by reference d.

According to the present embodiment, there are provided collecting and conveying poles 30, 31 at the upstream side with respect to the rotation of the carrying member 12, so that the accumulated magnetic particles are collected by the collecting and conveying poles 30, 31 and conveyed back into the the container 13 by the rotation of the carrying member 12. The strength of the collecting and conveying poles 30, 31 is preferably 200–600 G at the surface of the carrying member 12. This embodiment is shown as having the double poles as the collecting-conveying pole, it may be of a single pole structure, or triple or more structure. However, an assured effect is provided by the plural poles.

When the devices according to the foregoing embodiment was actually operated, good images with constant density were obtained irrespective of the ratio of the non-magnetic developer to the magnetic particles. And, it has been confirmed that the device is relatively insensitive to the change of ambient conditions.

As described above, according to this embodiment of the present invention, the leakage and scattering is positively prevented at the bottom of the container 13.

Figure 13:
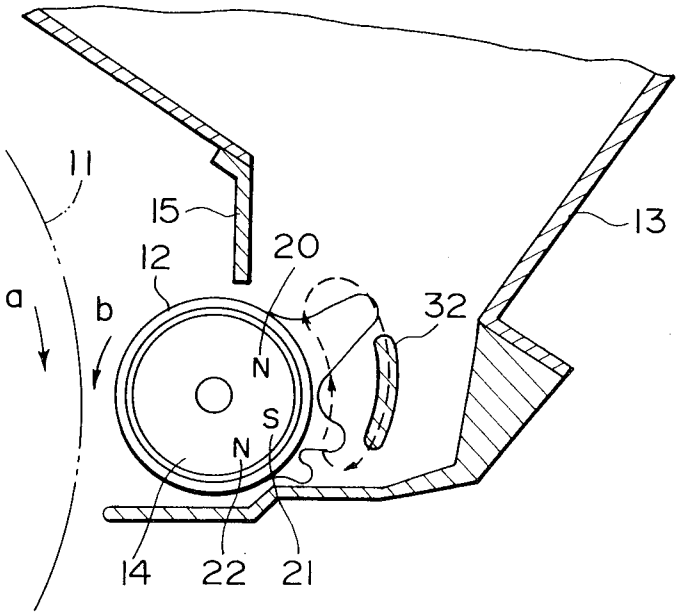
FIG. 13 is a cross-sectional view of the developing apparatus of FIG. 7, showing the magnetic flux density distribution.

The circulation of the magnetic particles will now be described in detail. FIG. 13 shows on polar coordinates a magnetic flux density distribution at the surface of the carrying member 12 when the magnet 14 having three poles is used. The magnetic flux density near the conveying pole 21 is lower than that near the confining pole 20, with the result that the effective magnetic field is limited to the neighborhood of the carrying member 12 surface. For this reason, the magnetic force does not act on the magnetic particles which are remote from the surface. It follows that, to the portion shown by reference numeral 32, the gravity force and the weight of the non-magnetic developer thereabove act relatively strongly. On the other hand, the confining pole 20 brings about a strong magnetic field sufficient to confine the magnetic particles. Therefore, the magnetic particles circulate together with the non-magnetic developer particles between the confining pole 20 and the sealing pole 22, as shown by the broken arrow. This embodiment has been described as having a single pole as the conveying pole 21, but it may have plural poles, if the respective poles have the magnetic flux density and half-peak width corresponding to the single pole, as a whole.

Each of the magnetic poles will be further described. The confining pole 20 is such that it provides 300–700 G at the surface of the carrying member 12. This is enough to perform its function, that is, to confine the magnetic particles within the container 13, while allowing the sufficient movement of the magnetic particles. The conveying pole 21 provides a lower value than this, 300–500 G. Then, the conveying pole 21 is effective to convey the magnetic particle together with the non-magnetic developer particles from adjacent the sealing pole 22 to adjacent the confining pole 20, and also the conveying force is limited to the neighborhood of the surface of the carrying member 12, since the magnetic brush is not high. The sealing pole 22 provides 200–600 G.

Figure 14:
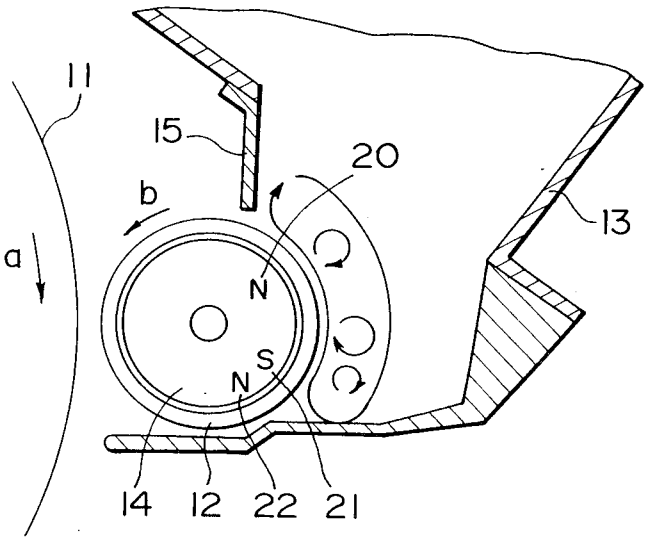
FIG. 14 is a cross-sectional view of a developing apparatus of FIG. 7, showing the circulation of the magnetic particles when operated.

FIG. 14 shows the circulation when the magnet 14 described with respect to FIG. 13 is used. Upon rotation of the carrying member 12, the magnetic particles and the non-magnetic developer particles circulate in small loops and circulate in a large loop as a whole in the container 13.

The non-magnetic developer is coated on the the carrying member 12 surface as a thin layer of uniform thickness by the image force. But, the magnetic particles are not allowed to go out of the container 13, since the magnetic particle confining force by the confining pole 20 is made stronger than the magnetic particle conveying force by the electrostatic attraction to the carrying member 12 surface plus mechanical friction force with the carrying member 12 surface. Instead, they move down toward the sealing pole 22 due to the circulation force by the confining pole 20 and the weight thereof.

Figure 16:
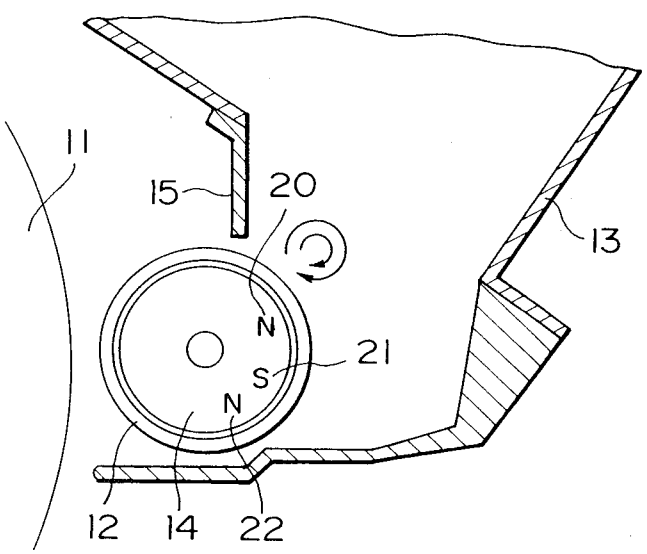
FIG. 16 is a cross-sectional view of the developing apparatus of FIG. 15, showing the circulation of the magnetic particles.
Figure 15:
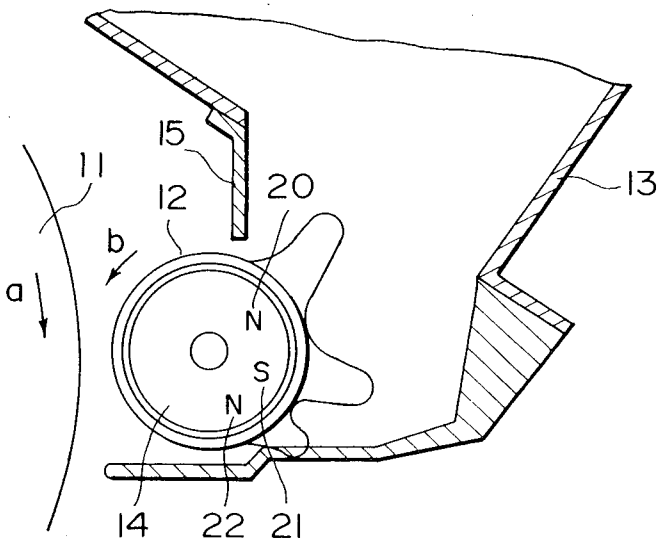
FIG. 15 is a cross-sectional view of a developing apparatus, showing the magnetic flux density distribution without using an aspect of the present invention.

FIG. 15 shows the magnetic flux density distribution when the magnetic flux density of the conveying pole 21 is made substantially equal to that of the confining pole 20. The magnetic flux densities of the confining pole 20 and the sealing pole 22 are the same as those of FIG. 13, namely 300–700 G and 200–600 G, respectively. With this magnetic flux density distribution, the circulation is similar to that of FIG. 13 arrangement, that is, as shown in FIG. 14, at the initial stage. However, with the increase of revolution the total number of the carrying member 12, the magnetic particles adjacent the sealing pole 22 are going to be trapped in the neighborhood of the confining pole 20 by the magnetic force of the conveying pole 21 and the conveying force of the carrying member 12 rotation. Finally, the circulation becomes as shown in FIG. 16. This is because the magnetic force by the conveying pole 21 is so strong that the magnetic particles taken from the confining pole 20 to the sealing pole 22 are completely trapped by the magnetic field of the confining pole 20 and the conveying pole 21.

Figure 17:
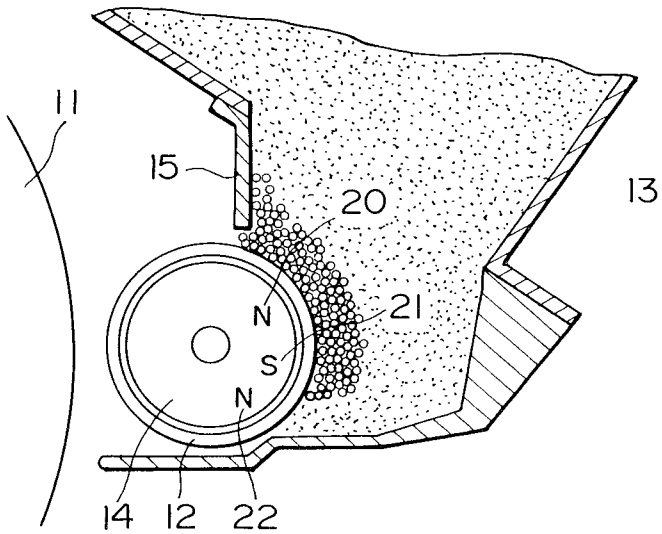
FIG. 17 is a cross-sectional view of a developing apparatus of FIG. 16, showing the distribution of magnetic particles after being operated for a period of time.

FIG. 17 shows the distribution of the magnetic particles within the container 13 when the circulation is as shown in FIG. 16. Since the travel of the circulation is short in this small circulation, the contact between the carrying member 12 and the non-magnetic developer particles is not sufficient, with the result of insufficient triboelectric charge, which leads to foggy developed images. In addition, as described hereinbefore, the non-magnetic developer particles and/or magnetic particles easily leak and are scattered adjacent the bottom of the container 13.

Figure 18:
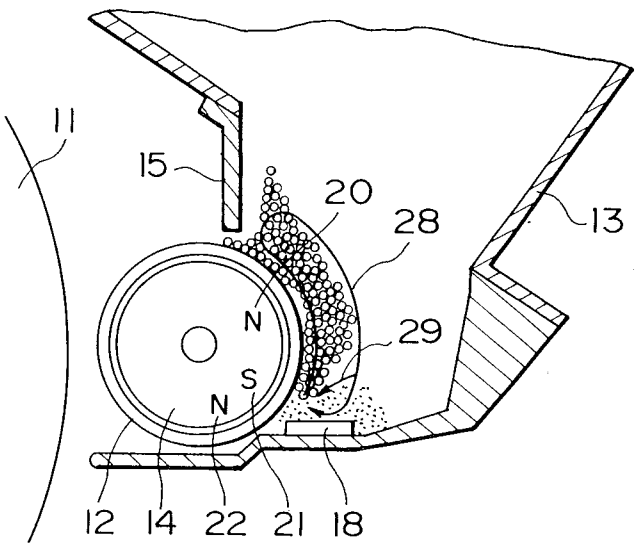
FIG. 18 is a cross-sectional view showing the change of the route of the circulation.

FIG. 18 illustrates a function of the sealing pole 22, which cooperates with the magnetic member 18 to form a magnetic brush between the magnetic member 18 and the surface of the carrying member 12 adjacent the sealing pole 22. The functions and effects of the magnetic member 18 are as described hereinbefore.

When the device according to the foregoing embodiment was actually operated, good images with constant density were obtained irrespective of the ratio of the non-magnetic developer to the magnetic particles. And, it has been confirmed that the device is relatively insensitive to the change of ambient conditions.

Figure 19:
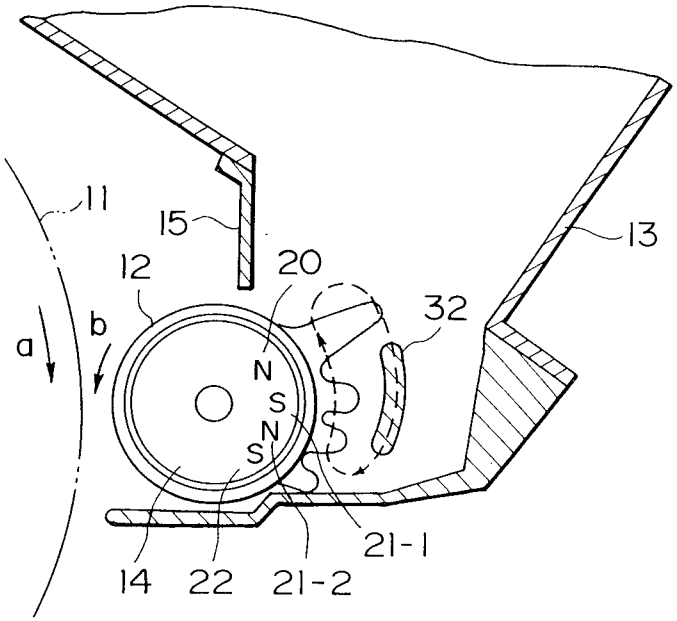
FIG. 19 is a cross-sectional view of a developing apparatus according to a further embodiment of the present invention.

FIG. 19 is a cross-sectional view of a further embodiment of the present invention, wherein the conveying pole 21 includes two magentic poles, namely, a magnetic pole 21-1 and a magnetic pole 21-2. As in this embodiment, the number of the conveying poles is not limited to one. But, even when plural poles are used, the magentic flux density, on the carrying member 12, of each of the magnetic poles is to be smaller than that of the confining poles 20. In this embodiment, the polarities of the magnetic poles 21-1 and 21-2 are opposite to each other, namely, the former is S and the latter is N. Proper magnetic flux density of each of the poles is 300–500 G. Similar satisfactory results were provided by this embodiment.

As described above, according to these embodiments, the conveying force by the conveying pole 21 is limited to the neighborhood of the surface of the carrying member 12 because of its small magnetic flux density, so that the conveying force thereof does not act on the magnetic particles remote from the carrying member 12. The remote magnetic particles are, therefore, more influenced by the moving force in the opposite direction (i.e. gravity), with the result that the magnetic particles travel a relatively larger loop between the confining pole 20 and the sealing pole 22. Because of this, the time during which the non-magnetic developer particles are contacted with the surface of the carrying member 12, is made longer to give sufficient triboelectric charge thereto, so that foggy developed images can be avoided.

Figure 20:
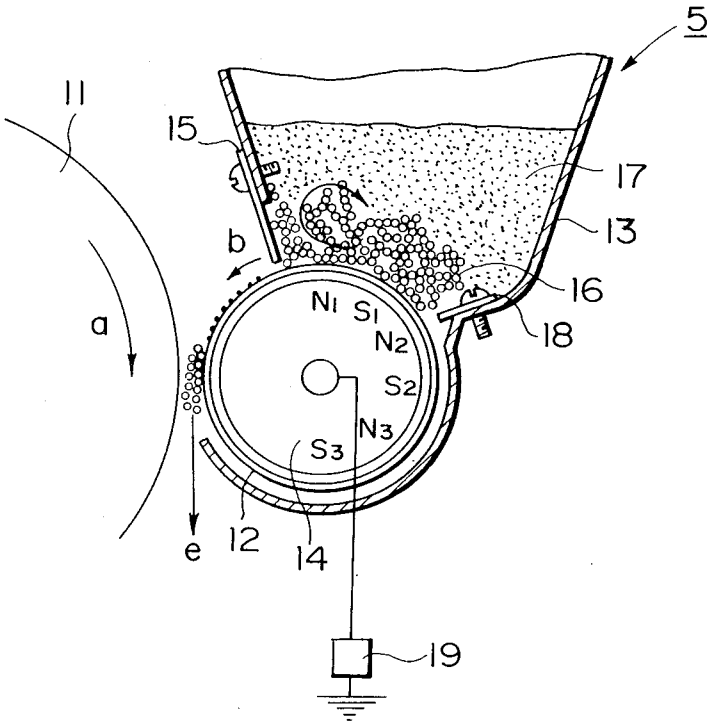
FIG. 20 is a cross-sectional view of a developing apparatus showing the disadvantage thereof.

FIG. 20 shows a further embodiment of the present invention. Since this embodiment is similar to the foregoing embodiment, except for the portions which will be described, the detailed description of the similar parts is omitted for the sake of simplicity by assigning the same reference numerals to the elements having corresponding functions.

In this embodiment, the container 13 is provided with the lower enclosure 13-1 to enclose the bottom of the carrying member 12 to prevent the developer from leaking out. The magnet 14 has a magnetic pole N1 for confining the magnetic particles within the container 13, a magnetic pole S1 for circulating the magnetic brush formed with the magnetic particles in accordance with the rotation of the carrying member 12, a magnetic pole N2 for forming a magnetic brush between the magnetic member 18 to prevent the non-magnetic developer particles from leaking out of the container 13. Magnetic poles S2, N3 and S3 are for collecting and conveying the magnetic particles as described with respect to FIG. 12.

This embodiment also has proved satisfactory results of the thin layer formation and uniform development without fog, as with the embodiments as described hereinbefore.

However, the above arrangement may lead to leakage of the magnetic particles, even though the amount is small, through the gap between the tip of the confining member 15 and the surface of the carrying member 12, as shown in FIG. 20 at the developing station. The magnetic particles, which have leaked out at the developing station, partly transfer to the surface of the photosensitive member 11 and partly remain on the carrying member 12. The former particles partly do not transfer onto a transfer material at a subsequent image transfer station and reach a cleaning station for cleaning the photosensitive member 11, where the magnetic particle will damage the delicate surface of the photosensitive member 11. The latter particles do not damage the photosensitive member 11, but, they can release, by the resultant force of gravity and the centrifugal force by the rotation of the carrying member 12, from the surface of the carrying member 12 to fall and scatter as shown in FIG. 20 by arrow e, thus staining the copying apparatus.

Figure 21:
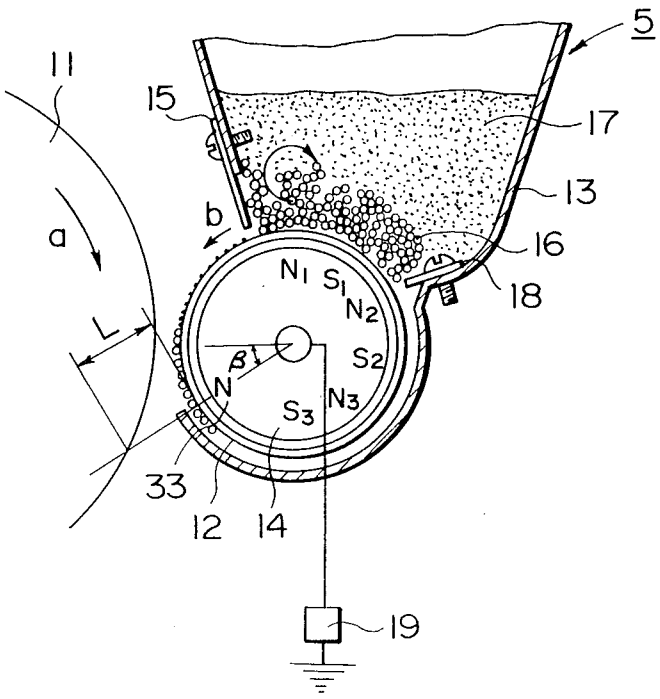
FIG. 21 is a cross-sectional view of a developing apparatus according to a further embodiment of the present invention.

FIG. 21 shows a further embodiment of the present invention. Since this embodiment is similar to the embodiment described with FIG. 20, except for the portions which will be described, the detailed description of the similar parts is omitted for the sake of simplicity by assigning the same reference numerals to the elements having the corresponding functions. In this embodiment, the magnet 14 has a magnetic particle retaining pole 33 at a position downstream, by an angle $\beta$ of the developing station where the carrying member 12 is opposed to the photosensitive member 11. The position is such that the distance L between the surface of the carrying member 12 and the surface of the photosensitive member 11, measured along the normal line on the carrying member 12 surface at a position opposed to the retaining pole 33, is not less than 1 mm and not more than 20 mm, preferably, not less than 2 mm and not more than 10 mm.

The retaining pole 33 may be formed in the magnet 14, or it may be a separate magnet. Because of the provision of this pole, the magnetic particles leaked through the gap between the confining member 15 and the carrying member 12 do not scatter outside the developing device, but are kept on the carrying member 12 to return into the container 13. Additionally, since the distance L between the surface of the carrying member 12 to the surface of the photosensitive member 11, measured along the normal line on the carrying member 12 surface at a position opposed to the retaining pole 33, is determined as described above, the magnetic particles incidentally transferred to the photosensitive member 11 is attracted back to the surface of the carrying member 12. Thus, the possible adverse effects of the leaked magnetic particles can be avoided. The angle $\beta$ formed between a line passing through the centers of the carrying member 12 and the photosensitive member 11, and a line passing through the center of the carrying member 12 and the retaining pole 33 is 10–30 degrees preferably 15–20 degrees when the diameters of the photosensitive member 11 and the carrying member 12 are 80 mm and 20 mm, respectively.

Figure 22:
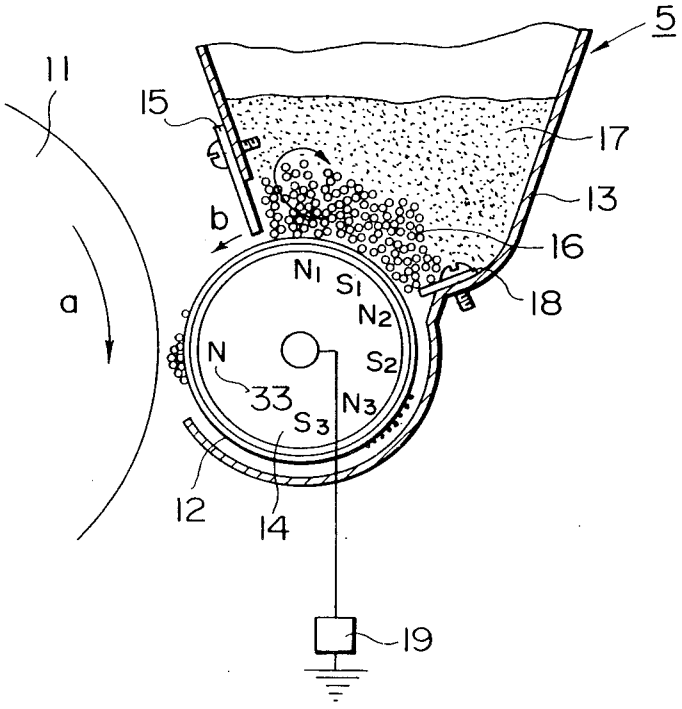
FIG. 22 is a cross-sectional view of a developing apparatus when a magnetic pole is opposed to a latent image bearing member.

FIG. 22 illustrates a case where the retaining pole 33 is not downstream of, but opposed to, the developing station, that is, where $\beta$ is zero, or where the ditance L between the surface of the carrying member 12 to the surface of the photosensitive member 11, measured along the normal line on the carrying member 12 surface at a position opposed to the retaining pole 33, is less than that described above.

In this case, the results are satisfactory at the initial stage. With the continuation of operation of the developing device, however, the amount of the leaked magnetic particles is integratedly increased to form a brush at the developing station. It is possible that the brush extends even to such an extent that the carrying member 12 and the photosensitive member 11 are short-circuited, which may result in a dielectric breakdown, which may cause a formation of pinholes in the photosensitive member 11. If this occurs, the expensive photosensitive member 11 becomes unusable.

If, on the other hand, the distance L is too large, the magnetic particles which have transferred to the photosensitive member 11 cannot be pulled back.

In view of the above, the distance L is not less than 1 mm and not more than 20 mm, preferably, not less than 2 mm and not more than 10 mm. This dimensional feature enhances the possibility that only the non-magnetic developer particles are transferred to the photosensitive member 11, and also, the magnetic particles incidentally transferred to the photosensitive member 11 are pulled back to the carrying member 12 by the retaining pole 33. Additionally, a developing device which is free from scattering of the leaked magentic particles, is provided.

The proper magnetic flux density at the surface of the carrying member 12 by the retaining pole 33 is 400–700 G, and the proper half-peak width at the surface 25–50 degrees. The magnetic flux density in the direction normal to the surface of the carrying member 12 is preferably less than 200 G at a position where the photosensitive member 11 and the carrying member 12 are closest to each other, so as not to allow stagnation of the magnetic particles there. With this strength, no electric discharge occurs between the photosensitive member 11 and the carrying member 12.

Satisfactory results were shown using the above-described embodiment of the present invention and with the following detailed structures.

The thin layer of the non-magnetic developer obtained by the above described structure was opposed to a photosensitive member 11 bearing an electrostatic latent image of +500 V at the dark area and −150 V at the light area with the clearance of 300 microns to the surface of the photosensitive member 11. The bias voltage of 800 Hz and peak-to-peak voltage of 1.8 KV with central value of +100 V was applied by the bias source 109. An NP200J copying machine (Canon Kabushiki Kaisha, Japan) was used, and good resultant images without ghost or fog were obtained.

Further, until 3000 copies were formed, that is, until most of the non-magnetic developer has been consumed, there was no variation of the image density and no leakage of the magnetic particles reached the developing station.

As described above according to this embodiment, the retaining pole 33 is located not opposed to the photosensitive member 11, but downstream of the opposed position with respect to the rotation of the carrying member 12, and in addition, the distance L between the surface of the carrying member 12 to the surface of the photosensitive member 11, measured along the normal line on the carrying member 12 surface at a positon opposed to the retaining pole 33, is not less than 1 mm and not more than 20 mm, so that the magnetic particles leaked and which reach the developing station are prevented from damaging the photosensitive member 11 and staining the inside or outside of the copying apparatus. Additionally, the magnetic particles incidentally transferred to the photosensitive member 11 can be attracted back to the surface of the carrying member 12.

Figure 23:
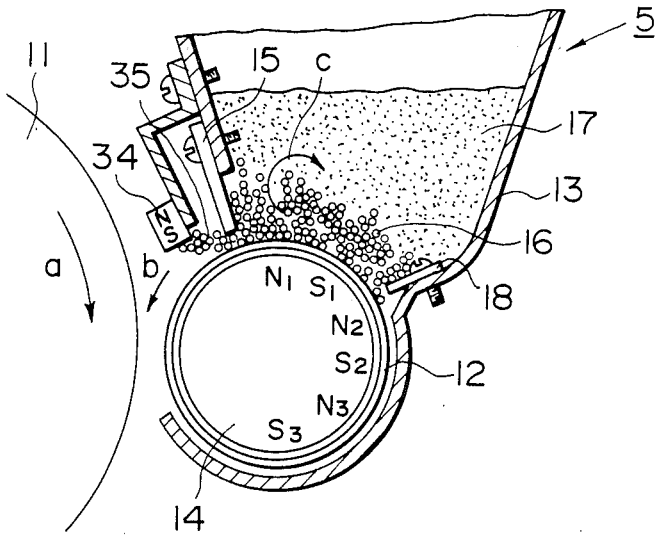
FIG. 23 is a cross-sectional view of a developing apparatus according to a further embodiment of the present invention.
Figure 24A:
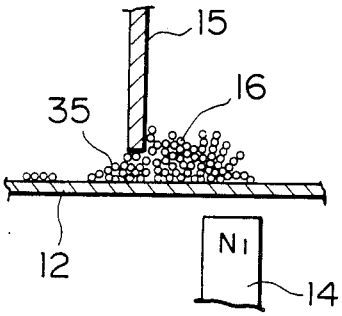
FIG. 24A is a part of a cross-sectional view of a developing apparatus without using an aspect of the present invention.
Figure 24B:
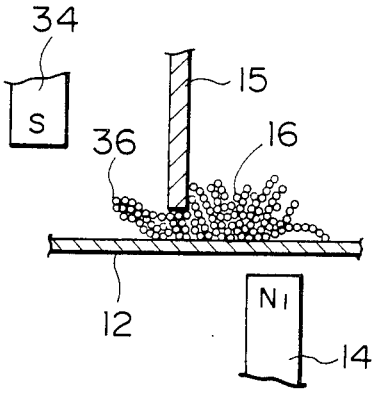
FIG. 24B is a part of a cross-sectional view of a developing apparatus using the aspect of the present invention.

FIGS. 23, 24A and 24B show a further embodiment of the present invention, in which the adverse affects by the leaked magnetic particles are eliminated. Since this embodiment is similar to the embodiment described with FIGS. 20 and 22, except for the portions which will be described, the detailed description of the similar parts is omitted for the sake of simplicity by assigning the same reference numerals to the elements having corresponding functions.

This embodiment includes an external magnet 34 which is an important feature of this embodiment. The external magnet 34 is provided to restrain the magnetic particles leaked through the gap between the confining member 15 and the carrying member 12. The function of the external magnet 34 will be described in detail in conjunction with FIGS. 24A and 24B.

FIG. 24A shows the state where there is no external magnet 34. When the magnetic particles contains finer particles, or the flowability of the developer is increased, the magnetic particles tend to leak out under the confining member 15. The leaked magnetic particles form a magnetic brush 35 by the magnetic field existing there. The magnetic brush extends downstream with respect to the rotation of the carrying member 12 in the direction approaching the surface of the carrying member 12 so that it comes to brush the carrying member 12 surface, and therefore, it scores the coating of the non-magnetic developer on the carrying member 12. This results in scores on the developed image or developer scattering. When the magnetic brush extends to a certain extent, it is torn and conveyed to the developing station to adversely affect the image development and the photosensitive member 11.

FIG. 24B shows a further embodiment of the present invention, wherein the external magnet 34 is employed, which is effective to catch the leaked magnetic particles so as to make the resultant magnetic brush extend away from the surface of the carrying member 12, as contrasted to the case of FIG. 24A, thus avoiding the above described inconveniences of scores and developer scattering. It is possible that the magnetic brush 36 extends with the operation even to the extent of reaching to the external magnet 34. If this occurs, it is required, in order for the magnetic particles to further leak, that they push the magnetic brush 26 up, and actually, the leakage is constrained, so that the magnetic brush 36 does not grow further. Thus, a good coating (without magnetic dparticle) operation is maintained over a long term, both before and after the formation of the magnetic brush 36.

The developing system to be used here is preferably the non-contact type development disclosed in U.S. Pat. No. 4,395,476. Between the photosensitive member 11 and the carrying member 12, a voltage is applied by a bias voltage source 19 which is of AC, DC or preferably an AC superposed with a DC.

An example was constructed according to this embodiment, wherein the surface of the sleeve was treated by irregular sand-blasting wit ALUNDUM abrasive.

Within the carrying member 12, magnet 14 magnetized with six poles was fixed in such a position that the magnetic particle confining pole of 500 G was 20–30 degrees away from the line connecting the center of the carrying member 12 and the tip of the confining member 15. The magnetic flux density of the other poles is 300–500 G. As for the magnetic particles, spherical ferrite of particle size 77–44 microns (200/300 mesh) and max. magnitization 190 emu/g, was used. For the non-magnetic developer, powder provided by a mixture of styrene/acrylic acid ester copolymer resin and copper phthalocyanine pigments and added by colloidal silica, was used. As for the external magnet, a plastic magnet providing a surface flux density of 800 G was used. The magnetic blade as the confining member 15 was made of a steel plate of 1 mm thickness. The tip thereof was 100–250 microns spaced apart from the surface of the developer carrying sleeve 12. The external magnet was 10–30 degrees apart from the magnetic blade 15 and also apart from the sleeve 12 by 3–5 mm. Such an arrangement and structure showed good results.

As described above, by the provision of the external magnet 34 downstream of the confining member 15, stabilized thin layer formation is assured, and the leakage of the magnetic particles is avoided which leads to adversely affecting the developed image and the photosensitive member 11, and in addition, the usable range of the properties of the magnetic particle and non-magnetic developer particle are made broader.

Figure 25:
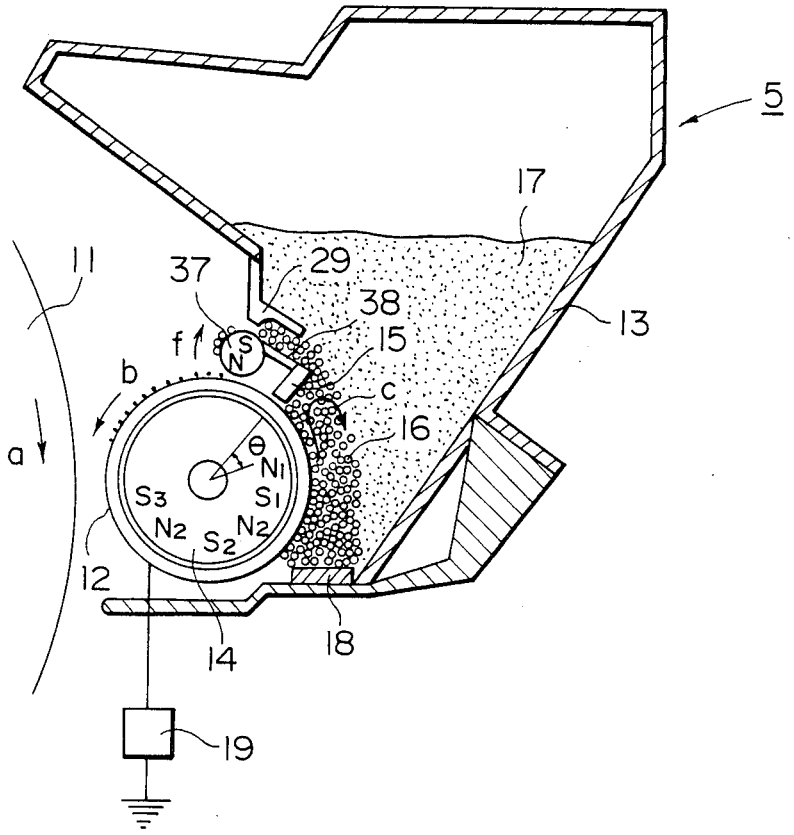
FIG. 25 is a cross-sectional view of a developing apparatus according to a further embodiment of the present invention.
Figure 26:
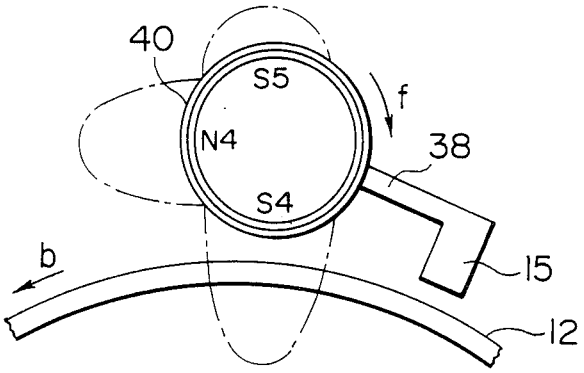
FIG. 26 is a part of a cross-sectional view of a developing apparatus according to a further embodiment of the present invention.
Figure 27:
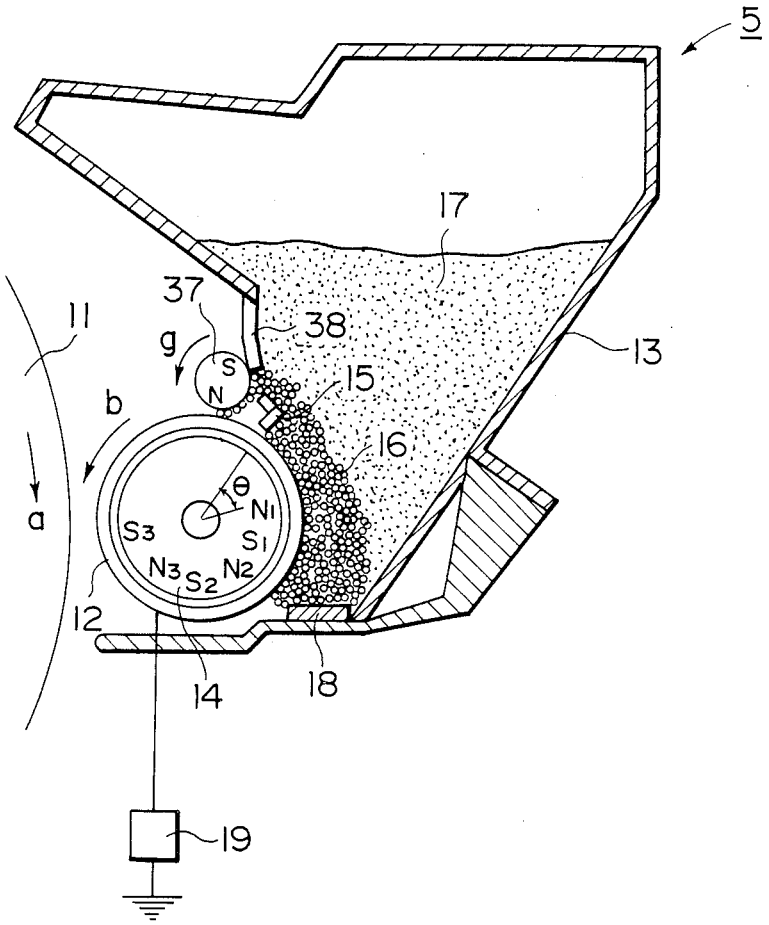
FIG. 27 is a part of a cross-sectional view of a developing apparatus according to a further embodiment of the present invention.

FIGS. 25–27 illusgtrate a further embodiment. Since this embodiment is similar to the foregoing embodiment, except for the portions which will be described, the detailed description of the similar parts is omitted for the sake of simplicity by assigning the same reference numerals of the elements having corresponding functions.

This embodiment includes magnetic particle collecting and recovering means comprising a collecting roll 37 of a magnet and scraper blade 38. As described above, the confining member 15 cooperates with the confining pole 20 to confine the magnetic particles within the container 13. However, when there are finer magnetic particles, or when the flowability of the non-magnetic developer particles is higher, the magnetic particles tend to leak through the gap therebetween. The leaked magnetic particles form a magnetic brush 35 as shown in FIG. 24A. The collecting roll 37 attracts the leaked magnetic particles thereon by its magnetic force and conveys by the rotation thereof in the direction shown by arrow f. The conveyed particles are scraped off from the surface of the collecting roll 37 by scraper blade 38 which is of a magnetic material and is provided in the proximity thereto. Above the scraper blade 38, there is a blocking member 29, which is effective to prevent the magnetic particles from coming to the neighborhood of scraper blade 38 from above, so that the magnetic particles removed from the surface of the collecting roll 37 is recovered into the container 13. The rotational speed of the collecting roll 37 may be lower than that of the carrying member 12, but it is dependent on the amount of the leaked magnetic particles. in this embodiment, the peripheral speed of the collecting roll 37 is approx. 6 mm/s, that is, 1/10 of that of the carrying member 12 (60 m/s), which showed good result without the developer leaking through the gap between the confining member 15 and the carrying member 12 and then reaching the developing station.

FIG. 26 shows a further embodiment, where the collecting roll 37 is fixed, around which is provided a rotational sleeve 40. The magnetic particles are attracted onto the surface of the sleeve 40 and conveyed by the cooperation of the magnetic field of the collecting roll 37 and rotation of the sleeve 40. The magnetic particles are then removed from the surface of the sleeve 40 by scraper blade 38 as in the previous embodiment, and recovered into the container 13. The fixed roll 37 has magnetic poles S4, N4, and S5 which provide magnetic flux density distribution as shown in FIG. 26. The pole S4 is a ladling pole, and has a sufficient magnetic flux density to catch the magnetic particles conveyed on the carrying member 12 at a relatively high speed. When the peripheral speed of the carrying member 12 is 100 mm/s, 600–800 G of the pole S4 was enough to collect most of the leaked magnetic particles. The poles N4 and S5 are conveying poles and provide magnetic flux density which is slightly lower than that of the ladling poles S5 so as to prevent the situation from taking place, wherein the magnetic particles are trapped between the poles to form a magnetic brush, which contacts the carrying member 12 to brush or scrape the thin layer coating of the non-magnetic developer. The magnetic flux density of 400–600 G showed a good result without such a trapping, and with a smooth recovery of the magnetic particles into the container 13. Adjacent to scraper blade 38, there is hardly any magnetic field in order to assure the efficiency of the magnetic particle removal. The magnetic particles having reached theneighborhood of scraper blade 38 are not influenced by the magnetic field and removed from the surface of the sleeve 40 by the weight and the scraping function of scraper blade 38 and recovered into the container 13.

FIG. 27 shows a further embodiment. In FIG. 25, the surface of the collecting roll 37 is moved in the direction f, same as the surface of the carrying member 12. In FIG. 27, however, it moves in the opposite direction g. The magnetic particles undesirably passed through the gap between the confining member 15 and the carrying member 12, are caught on the collecting roll 37 by the strong magnetic force of the collecting roll 37 and conveyed thereon with the rotation thereof to the neighborhood of scraper blade 38, where it is scraped by the scraper, to be recovered into the container 13.

With the codirectional rotation, the relative speed is low between the collecting roll 37 and the carrying member 12, so that the time during which the collecting roll 37 surface and the carrying member 12 surface are close to each other is longer than the case of counter-directional rotation, and therefore, the amount of the caught magnetic particles per unit area of the collecting roll 37 surface is larger. It follows that the co-directional arrangment is effective even when a lower magnetic flux density of the collecting roll 37 is used, but in order to keep the low relative speed to the surface of the carrying member 12, it is required to increase the speed of the collecting roll 37. In the case of the counter-directional arrangement, on the contrary, the amount of the caught magnetic particles per unit area is smaller, but the rotational speed may be lower than in the codirectional arrangement. Thus, the co-directional and the counter-directional arrangements have their own advantages and disadvantages. Either arrangement is possible to obtain the desired effects.

As for the material of scraper blade 38, it may be magnetic or non-magnetic. However, from the standpoint of preventing the non-magnetic developer particles and magnetic particles from scattering between the collecting roll 37 and scraper blade 38, a magnetic scraper blade 38 is preferable, since it can form a magnetic brush between the collecting roll 37 and scraper blade 38. The magnetic brush can almost completely prevent the scattering of the non-magnetic developer particles and the magnetic particles.

The developing apparatus of the present invention was operated with good results, namely, the magnetic particles were completely confined within the container 13, and there were only the non-magnetic developer particles on the carrying member 12 in the developing staition.

The thin layer of the non-magnetic developer obtained by the above structure was opposed to a photosensitive member 11 bearing an electrostatic latent image of −750 V at the dark area and −250 V at the light area with the clearance of 100 microns to the surface of the photosensitive member 11. The bias voltage of 1.6 KHz and peak-to-peak voltage of 1.3 KV with central value of −350 V was applied by the bias source 19. A PC-20 copying machine (Canon Kabushiki Kaisha, Japan) was used, and good resultant image without ghosts or fog were obtained.

Further, until 2000 copies were formed, that is, until most of the non-magnetic developer has been consumed, there was no variation of the image density without the leakage of the magnetic particles reaching the developing station.

As described above, according to this embodiment, by the provision of the magnetic particle collecting and recovering means 37, 38 and 40, the magnetic particles, unintentionally leaked through the gap between the confining member 15 and the carrying member 12, are caught and recovered before reaching the developing station, so that the adverse affect to the developed image and/or to the photosensitive member 11 is avoided, and also that a wider range of the non-magnetic developer particles and the magnetic particles are made usable.

In the embodiments described above, the confining member 15 has been explained as of a magnetic material, such as steel. However, a non-magnetic confining member 15 made may be of a non-magnetic material such as, aluminium, copper and resin. Also, the wall of the container 13, if it is made of a non-magentic material, may be used as the confining member 15. In this case, the clearance between the tip of the confining member 15 and the surface of the carrying member 12 is needed to be smaller than the clearance when the magnetic confining member 15 is used. The magnetic confining member 15 is preferable in that a stabilized magnetic brush is formed at the developer outlet by the magnetic field between the confining member 15 and the magnetic pole.

While the invention has been described with reference to the structures disclosed herein, it is not confined to the details set forth and this application is intended to cover such modifications or changes as may cme within the purposes of the improvements or the scope of the following claims.

What is claimed is:

1. A developing apparatus, comprising:

a developer supply container, having an opening, for containing a non-magnetic developer and magnetic particles;

an endlessly movable developer carrying member formed of a non-magnetic material for carrying the developer, which is transferred from the inside of said developer supply container to the outside of said developer supply container through the opening, said developer carrying member passing by a developing station which is outside of said developer supply container where said developer carrying member is positioned to be in opposition to a latent image bearing member;

a magnetic particle confining member, spaced by a predetermined gap from an outer surface of said developer carrying member;

means for generating a fixed magnetic field, having magnetic pole means, disposed inside of said carrying member and upstream of said confining member with respect to the movement of said developer carrying member, wherein said confining member and said magnetic pole means cooperate to confine the magnetic particles within said developer supply container and to form a developer layer of the non-magnetic developer on the outer surface of said developer carrying member;

a magnet, disposed outside of said carrying member and downstream of said confining member and upstream of said developing station with respect to the movement of said developer carrying member, for forming a line of magnetic force extending therefrom to said confining member, the magnetic force of the magnet being effective to confine the magnetic particles which have escaped from said container.

2. An apparatus according to claim 1, wherein said magnetic particle confining member has a magnetic blade having a free end which is spaced around said developer carrying member from said magnetic pole means with an angular spacing, measured at a center of rotation of said developer carrying member, by not less than 5 degrees and not more than 50 degrees, and wherein said magnet is disposed such that it is spaced around said developer carrying member from the free end of said magnetic blade with an angular spacing, measured at the center of rotation of said developer carrying member, by not less than 10 degrees and not more than 30 degrees.

3. An apparatus according to claim 2, wherein the gap between said developer carrying member and said confining member is not more than 250 microns, and wherein said magnet is spaced from the surface of said developer carrying member by not more than 5 mm.

4. A developing apparatus, comprising:

a developer supply container, having an opening, for containing a non-magnetic developer and magnetic particles;

an endlessly movable developer carrying member of a non-magnetic material for carrying a developer, which is movable between an inside of said developer supply container and an outside of said developer supply container through the opening, said developer carrying member passing by a developing station which is outside of said developer supply container where said developer carrying member is positioned to be in opposition to a latent image bearing member;

a magnetic particle confining member, spaced by a predetermined gap from an outer surface of said developer carrying member;

means for generating a fixed magnetic field, having magnetic pole means, disposed inside of said carrying member and upstream of said confining member with respect to the movement of said developer carrying member, wherein said confining member and said magnetic pole means cooperate to confine the magnetic particles within said developer supply container and to form a developer layer of the non-magnetic developer on the outer surface of said developer carrying member; and means, disposed outside of said carrying member and downstream of said confining member and upstream of said developing station with respect to the movement of said developer carrying member, for collecting the magnetic particles which have passed through the gap between said confining member and said developer carrying member and recovering them in said container.

5. An apparatus according to claim 4, wherein said collecting and recovering means includes a member rotatable to provide a peripheral movement in said direction as the movement of said developer carrying member to magnetically collect the magnetic particles.

6. An apparatus according to claim 5, wherein said collecting and recovering means further includes a magnetic scraper which contacts the rotatable member to remove the magnetic particles therefrom.

7. A developing apparatus, comprising:

a developer supply container, having an opening, for containing a non-magnetic developer and magnetic particles;

an endlessly movable developer carrying member of a non-magnetic material for carrying a developer, which is movable between an inside of said developer supply container and an outside of said developer supply container through the opening, said developer carrying member passing by a developing station which is outside of said developer supply container where said developer carrying member is positioned to be in opposition to a latent image bearing member at the developing station;

means, provided inside of said carrying member, for generating a fixed magnetic field;

a regulating member for forming, on said developer carrying member, a developer layer containing the non-magnetic developer and the magnetic particles discharged from said container and for regulating a thickness of the developer layer to be smaller than a gap formed between the latent image bearing member and said developer carrying member;

means for forming an alternating electric field across the gap between the latent image bearing member and said developer carrying member, wherein said fixed magnetic field generating means is provided with a magnetic pole, disposed downstream of a position where said developer carrying member is closest to the latent image bearing member with respect to movement of said developer carrying member, for attracting and conveying the magnetic particles which have passed through the developing station, wherein a line connecting a center of rotation of the latent image bearing member and a center of rotation of said developer carrying member and a line connecting a center of rotation of said developer carrying member and the downstream magnetic pole form an angle of not more than 30 degrees.

8. An apparatus according to claim 7, wherein said angle is not less than 10 degrees.

9. An apparatus according to claim 8, wherein said angle is not less than 15 degrees and not more than 20 degrees.

10. An apparatus according to claim 7, wherein at said closest position a component of a magnetic flux density in a direction connecting the center of the latent image bearing member and the center of said developer carrying member is not more than 200 Gauss.

11. An apparatus according to claim 7, wherein a distance L between the surface of said carrying member and the surface of said latent image bearing member, measured along a line normal to the surface of said developer carrying member at a position opposed to said magnetic pole, is not less than 1 mm and not more than 20 mm.

12. An apparatus according to claim 11, wherein the distance L is not less than 2 mm and not more than 10 mm.

13. An apparatus according to claim 7, wherein said magnetic pole produces a magnetic field of not less than 400 Gauss and not more than 700 Gauss at the surface f said developer carrying member.

14. A developing apparatus, comprising:

a developer supply container, having an opening, for containing a non-magnetic developer and magnetic particles;

an endlessly movable developer carrying member of a non-magnetic material for carrying a developer, which is movable between an inside of said developer supply container and an outside of said developer supply container through the opening, and positioned to be in opposition to a latent image bearing member at a developing station;

means, provided inside a said carrying member, for generating a fixed magnetic field;

a regulating member for forming, on said developer carrying member, a developer layer containing the non-magnetic developer and the magnetic particles discharged from said container and for regulating a thickness of the developer layer to be smaller than a gap formed between the latent image bearing member and said developer carrying member;

means for forming an alternating electric field across the gap between the latent image bearing member and said developer carrying member, wherein said fixed magnetic field generating means is provided with a magnetic pole, disposed downstream of a position where said developer carrying member is closest to the latent image bearing member with respect to movement of said developer carrying member, for attracting and conveying the magnetic particles which have passed through the developing station, wherein a distance L between the surface of said carrying member and the surface of said latent image bearing member, measured along a line normal to the surface of said developer carrying member at a position opposed to said magnetic pole, is not less than 1 mm and not more than 20 mm.

15. A developing apparatus, comprising:

a developer supply container, having an opening, for containing a non-magnetic developer and magnetic particles;

an endlessly movable developer carrying member of a non-magnetic material for carrying a developer, which is movable between an inside of said developer supply container and an outside of said developer supply container through the opening, and positioned to be in opposition to a latent image bearing member at a developing station;

means, provided inside of said carrying member, for generating a fixed magnetic field;

a regulating member for regulating a thickness of the developer discharged from said container by said developer carrying member; and developer collecting means, disposed at a lower portion of said developer container, having a portion bent away from the latent image bearing member toward said container by an angle of not less than 90 degrees, wherein said developing apparatus is detachably mountable to am image forming apparatus.

16. A developing apparatus, comprising:

a developer supply container, having an opening, for containing a non-magnetic developer and magnetic particles;

an endlessly movable developer carrying member of a non-magentic material for carrying a developer, which is movable between an inside of said developer supply container and an outside of said developer supply container through the opening;

means, provided inside of said carrying member, for generating a fixed magnetic field;

wherein said container has a bottom portion which contains the non-magnetic developer and the magnetic particles, said developer carrying member moving substantially upwardly from the bottom portion of said container; and a stirring member rotatable in a direction opposite to a direction of rotation of said developer carrying member and having a center of rotation in the bottom portion of the container, said stirring member being effective to move the developer toward an upstream side of the movement of said developer carrying member by the portion of said stirring member lower than its rotational center.

17. An apparatus according to claim 16, wherein said stirring member rotates in the range of 8 to 60 r.p.m.

18. A developing apparatus, comprising:

a developer supply container, having an opening, for containing a non-magnetic developer and magnetic particles;

an endlessly movable developer carryaing member of a non-magnetic material for carrying a developer, which is movable between an inside of said developer supply container and an outside of said developer supply container through the opening;

means, provided inside of said carrying member, for generating a fixed magnretic field;

a regulating member, disposed outside of said developer carrying member, cooperable with said magnetic field generating means to regulate the developer within said container;

a magnetic member disposed inside of said container upstream of said confining member with respect to the movement direction of said developer carrying member, wherein said fixed magnetic field generating means includes a first sealing magnetic pole for forming a magnetic seal for preventing the magnetic particles from leaking out of said container at a bottom portion thereof and a collecting and recovering magnetic pole disposed between a developing station and said sealing magnetic pole to collect the magnetic particles leaked adjacent said regulating member, adjacent said magnetic number in said container.

* * * * *

UNITED STATES PATENT AND TRADEMARK OFFICE

CERTIFICATE OF CORRECTION

PATENT NO. : 4,660,958

DATED : April 28, 1987

INVENTOR(S) : HIDEMI EGAMI, ET AL.

It is certified that error appears in the above-identified patent and that said Letters Patent is hereby corrected as shown below:

At [30] UNDER FOREIGN APPLICATION PRIORITY DATA

Line 1, "09161983" should read --Japan--.

COLUMN 1

Line 23, "necessiated" should read --necessitated--.

COLUMN 2

Line 14, "extends" should read --extend--.
Line 33, "inventin" should read --invention--.
Line 45, "affects" should read --effects--.
Line 65, "of a" should read --of an--.

COLUMN 3

Line 16, "after operated" should read --after being operated--.

COLUMN 4

Line 10, "embodiment" should read --embodiments--.

COLUMN 5

Line 19, "confing" should read --confining--.
Line 28, "layers" should read --layer--.
Line 31, "The particles" should read --The particle--.
Lines 31-32, "particle" should read --particles--.

UNITED STATES PATENT AND TRADEMARK OFFICE

CERTIFICATE OF CORRECTION

PATENT NO. : 4,660,958

DATED : April 28, 1987

INVENTOR(S) : HIDEMI EGAMI, ET AL.

It is certified that error appears in the above-identified patent and that said Letters Patent is hereby corrected as shown below:

COLUMN 6

Line 3, "neighbourhood" should read --neighborhood--.
Line 17, "meember" should read --member--.
Line 25, "develope" should read --developer--.
Line 62, "layer" should read --layers--.

COLUMN 8

Line 15, "as" should read --a--.
Line 28, "particle" should read --particles--.
Line 65, "the the" should read --the--.

COLUMN 10

Line 15, "particle" should read --particles--.
Line 19, "theof," should read --thereof,--.
Line 33, "magnitization" should read --magnetization--.
Line 59, "the the" should read --the--.

COLUMN 11

Line 40, "particle" should read --particles--.
Line 53, "the the" should read --the--.

COLUMN 12

Lines 6-7, "revolution the total number of the" should read --the total number of revolutions of the--.
Line 43, "magentic" should read --magnetic--.
Line 47, "magentic" should read --magnetic--.
line 49, "poles" should read --pole--.

UNITED STATES PATENT AND TRADEMARK OFFICE

CERTIFICATE OF CORRECTION

PATENT NO. : 4,660,958

DATED : April 28, 1987

INVENTOR(S) : HIDEMI EGAMI, ET AL.

It is certified that error appears in the above-identified patent and that said Letters Patent is hereby corrected as shown below:

COLUMN 14

Line 23, "ditance" should read --distance--.
Line 52, "particles, is" should read --particles is--.
Line 56, "surface 25-50" should read --surface is 25-50--.

COLUMN 15

Line 9, "109." should read --19.--.
Line 24, "positon" should read --position--.
Line 34, "affects" should read --effects--.

COLUMN 16

Line 12, "dparticle)" should read --particle)--.
Line 23, "wit" should read --with--.
Line 32, "magnitization" should read --magnetization--.
Line 54, "illusgtrate" should read --illustrate--.
Line 59, "of" should read --to--.

COLUMN 17

Line 18, "in" should read --In--.
Line 20, "(60 m/s)," should read --(60mm/s),--.
Line 43, "poles" should read --pole--.
Line 55, "theneighborhood" should read --the neighborhood--.

UNITED STATES PATENT AND TRADEMARK OFFICE

CERTIFICATE OF CORRECTION

PATENT NO. : 4,660,958

DATED : April 28, 1987

INVENTOR(S) : HIDEMI EGAMI, ET AL.

It is certified that error appears in the above-identified patent and that said Letters Patent is hereby corrected as shown below:

COLUMN 18

Line 3, "codirectional" should read --co-directional--.
Line 38, "staition." should read --station--.
Line 48, "image" should read --images--.
Line 61, "affect" should read --effect--.

COLUMN 19

Line 16, "cme" should read --come--.

COLUMN 21

Line 44, "f" should read --of--.
Line 57, "a" should read --of--.

COLUMN 22

Line 36, "am" should read --an--.
Line 43, "non-magentic" should read --non-magnetic--.

COLUMN 23

Line 1, "carryaing" should read --carrying--.

UNITED STATES PATENT AND TRADEMARK OFFICE

CERTIFICATE OF CORRECTION

PATENT NO. : 4,660,958

DATED : April 28, 1987

INVENTOR(S) : HIDEMI EGAMI, ET AL.

It is certified that error appears in the above-identified patent and that said Letters Patent is hereby corrected as shown below:

COLUMN 24

Line 11, "number" should read --member--.

Signed and Sealed this

Sixteenth Day of February, 1988

*Attest:*

*Attesting Officer*

DONALD J. QUIGG

*Commissioner of Patents and Trademarks*